United States Patent [19]

Emmerich

[11] 4,213,022

[45] Jul. 15, 1980

[54] TWO-PRESSURE TYPE CIRCUIT INTERRUPTER

[75] Inventor: Werner S. Emmerich, Churchill Borough, Pa.

[73] Assignee: Westinghouse Electric Corp., Pittsburgh, Pa.

[21] Appl. No.: 902,008

[22] Filed: May 1, 1978

[51] Int. Cl.[2] ..... H01H 33/82

[52] U.S. Cl. ..... 200/148 R; 200/148 A; 200/148 B

[58] Field of Search ..... 200/148 R, 148 A, 148 B, 200/148 C, 148 D, 148 E, 148 F, 148 G, 148 H, 148 J, 148 BV

[56] References Cited

U.S. PATENT DOCUMENTS

| | | | |
|---|---|---|---|
| 3,291,947 | 12/1966 | Van Sickle | 200/148 H |
| 3,327,082 | 6/1967 | Van Sickle et al. | 200/148 H |
| 3,720,799 | 3/1973 | Eidinger et al. | 200/148 B |

*Primary Examiner*—J. V. Truhe
*Assistant Examiner*—Morris Ginsburg
*Attorney, Agent, or Firm*—L. P. Johns

[57] ABSTRACT

A high-compression two-pressure type circuit interrupter characterized by cylinder means separated into two gas-tight compartments by a pressure responsive divider, one compartment containing an arc-extinguishing gas, the other compartment containing an operating gas for moving the arc-extinguishing gas when an overload occurs.

5 Claims, 3 Drawing Figures

TWO-PRESSURE TYPE CIRCUIT INTERRUPTER

CROSS REFERENCE TO RELATED APPLICATION

This invention is related to the application Ser. No. 902,009, filed May 1, 1978 of Werner S. Emmerich.

BACKGROUND OF THE INVENTION

1. Field of the Invention

This invention relates to circuit interrupters and, more particularly, it pertains to a two-pressure type circuit breaker for extinguishing arcs occurring between separating contacts.

2. Description of the Prior Art

It is well known that the performance of an arc-extinguishing gas, such as sulfur hexafluoride, as a current interrupting medium increases with the difference between the upstream and downstream pressures; that is, the pressure drop through the interrupter nozzle. Two gas handling methods have evolved, the puffer and the two-pressure systems, to obtain this pressure drop. In the puffer type circuit breaker the upstream gas is compressed by a piston which operates during the opening stroke. However, in the two-pressure system, the upstream gas is compressed ahead of time and discharged during the opening stroke by means of a valve.

In the puffer type circuit breaker the piston is physically connected to the movable electrode. The device is therefore limited to the compression ratio that can be produced by the motion of the piston. The ratio is normally quite small, but there are circumstances when the pressure ratio gets very high during arcing. A blowback situation can occur during the high current pressure of the cycle to cause clogging of the orifice and stopping of the mechanism. The additional pressure difference developed during this period is available for extinguishing the arc at the next current zero, provided the gas that was pushed upstream is cool enough. It has been found that metallic coolers are important in the upstream region; pressures of 25–30 atmospheres with a primary filling of 4 atmospheres have been reported.

In the two-pressure system, the pressure drop is limited by the boiling point of $SF_6$ which allows about 16 atmospheres for the upstream pressure, if the reservoir is maintained at room temperature. The downstream pressure can be essentially atmospheric. It has been found however that every effort must be made to prevent severe clogging.

SUMMARY OF THE INVENTION

In accordance with this invention it has been found that problems inherent in the design and operation of two-pressure type circuit interrupters may be overcome by providing a circuit interrupter comprising a housing, a stationary contact within the housing, a movable contact within the housing and separable from the stationary contact to establish an arc, mounting means for mounting and moving the movable contact, means for directing a blast of an interrupting gas into the zone between the separating contacts to extinguish an arc and comprising a puffer cylinder and conduit means extending between the cylinder and said zone, the mounting means also comprising a tubular portion and the conduit means communicating with the tubular portion, the puffer cylinder being separated into two gas-tight compartments by a pressure responsive divider, one compartment having an outlet port communicating with the conduit means and containing an arc-extinguishing gas, the other compartment communicating with a source of pressurized fluid, the divider being a piston movably mounted in the cylinder in response to increased pressure of the gas in either compartment, the one compartment having inlet port means comprising one-way valve means for closing the inlet port means to reverse the flow of said gas when the contacts are separated, and valve means for releasing the fluid into said other compartment in response to a current overload to push the gas from the one compartment to the zone.

The advantage of the circuit interrupter of this invention is that an increase in instantaneous pressure is accomplished through rapid adiabatic compression of the gas in the reservoir volume by mechanical, hydraulic, or pneumatic means.

DESCRIPTION OF THE PREFERRED EMBODIMENT

Figure 1:
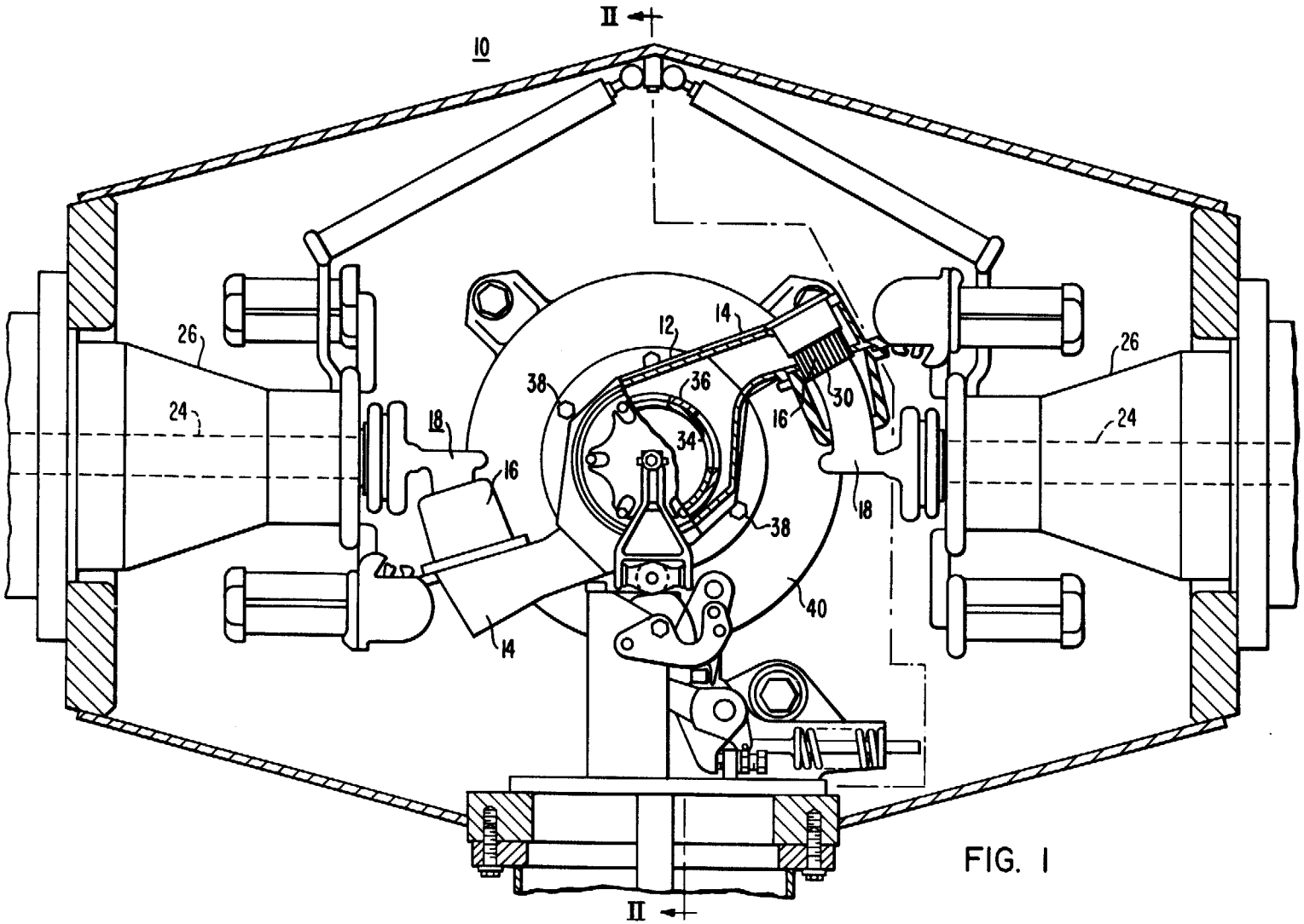
FIG. 1 is a vertical sectional view of an interrupting head of one of the pole units of a compressed-gas circuit interrupter taken on the line I—I of FIG. 2 with the separable contacts shown in the closed-circuit position.

In FIG. 1 a compressed-gas circuit interrupter is shown having a rotative moving contact arm assembly, such as disclosed in U.S. Pat. Nos. 3,291,947 and 3,327,082, which are incorporated by reference herein. In those patents, a complete description of the mechanism and operation is provided for compressed-gas circuit interrupters having a double-rig hollow rotative moving contact-arm assembly, for which reason the description herein is limited to only the essential parts.

Figure 2:
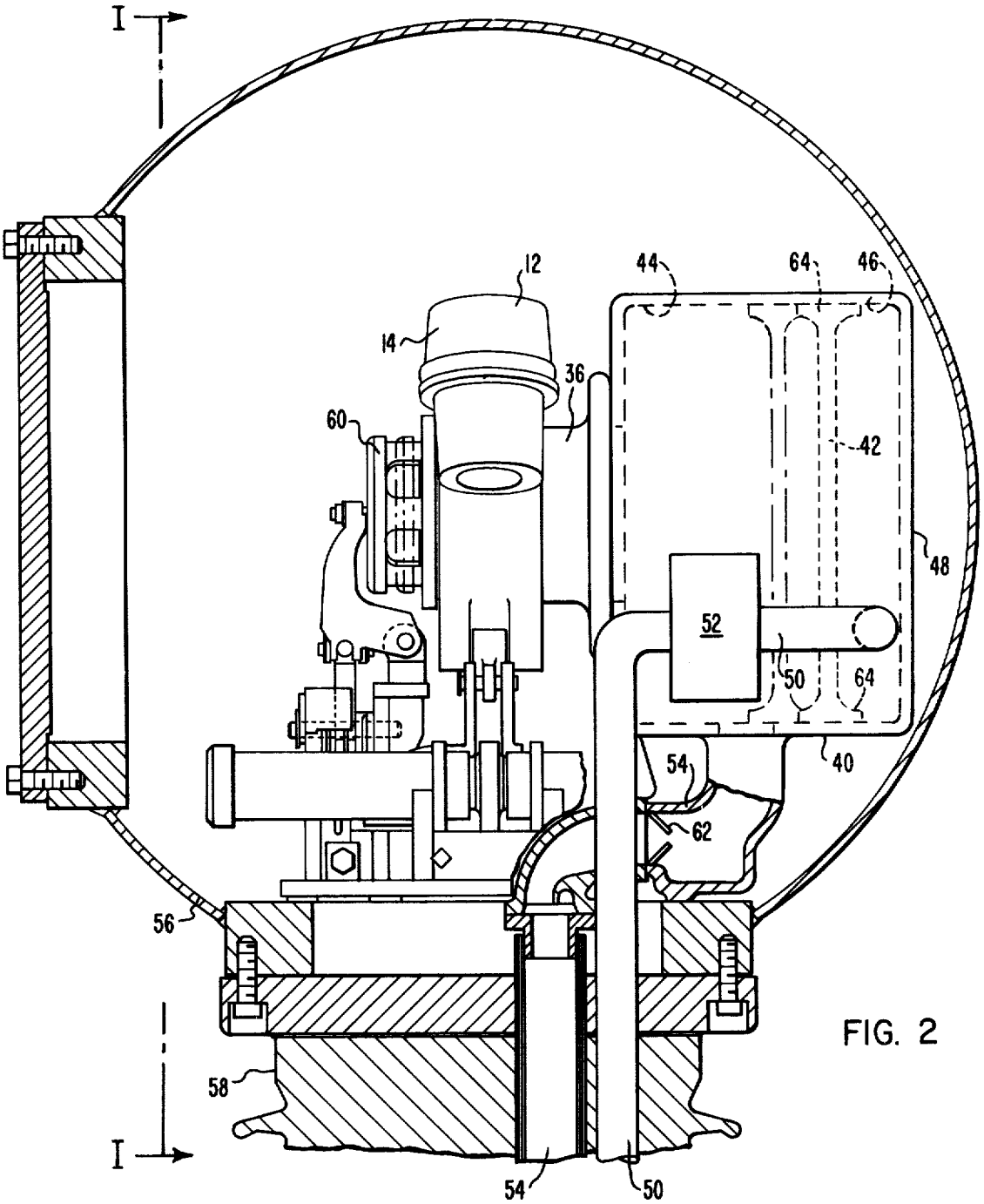
FIG. 2 is a horizontal sectional view taken substantially along the line II—II of FIG. 1 with certain parts being omitted for clarity and embodying the principles of the present invention.

In FIGS. 1 and 2 an interrupting head unit is generally indicated at 10 and it comprises a rotating bridge contact cross-arm assembly 12 which includes a pair of radial outwardly-extending gas conducting arms 14 carrying movable contacts 16. Each movable contact 16 separates from a relatively stationary contact structure 18 to establish an arc 20 (FIG. 3) which is extinguished by an intensive gas flow generally indicated by gas-flow arrows 22. The stationary contacts 18 are supported and clamped to terminal studs 24 extending through terminal bushings 26, the latter protruding through the ends of the interrupting head units 10. Generally, the circuit interrupting structure operates during the opening and closing operations of the contacts to effect rotation of the cross-arm assemblies 12 to consequently bring about a closing, or alternately, an opening of the electrical circuit through the circuit interrupter.

Each movable contact 16 comprises a movable tubular arcing horn 28 (FIG. 3) and a plurality of surrounding circumferentially disposed spring-biased main contact fingers 30. The fingers 30 conductively engage with the outer sides of the stationary tubular contact structure 18.

Figure 3:
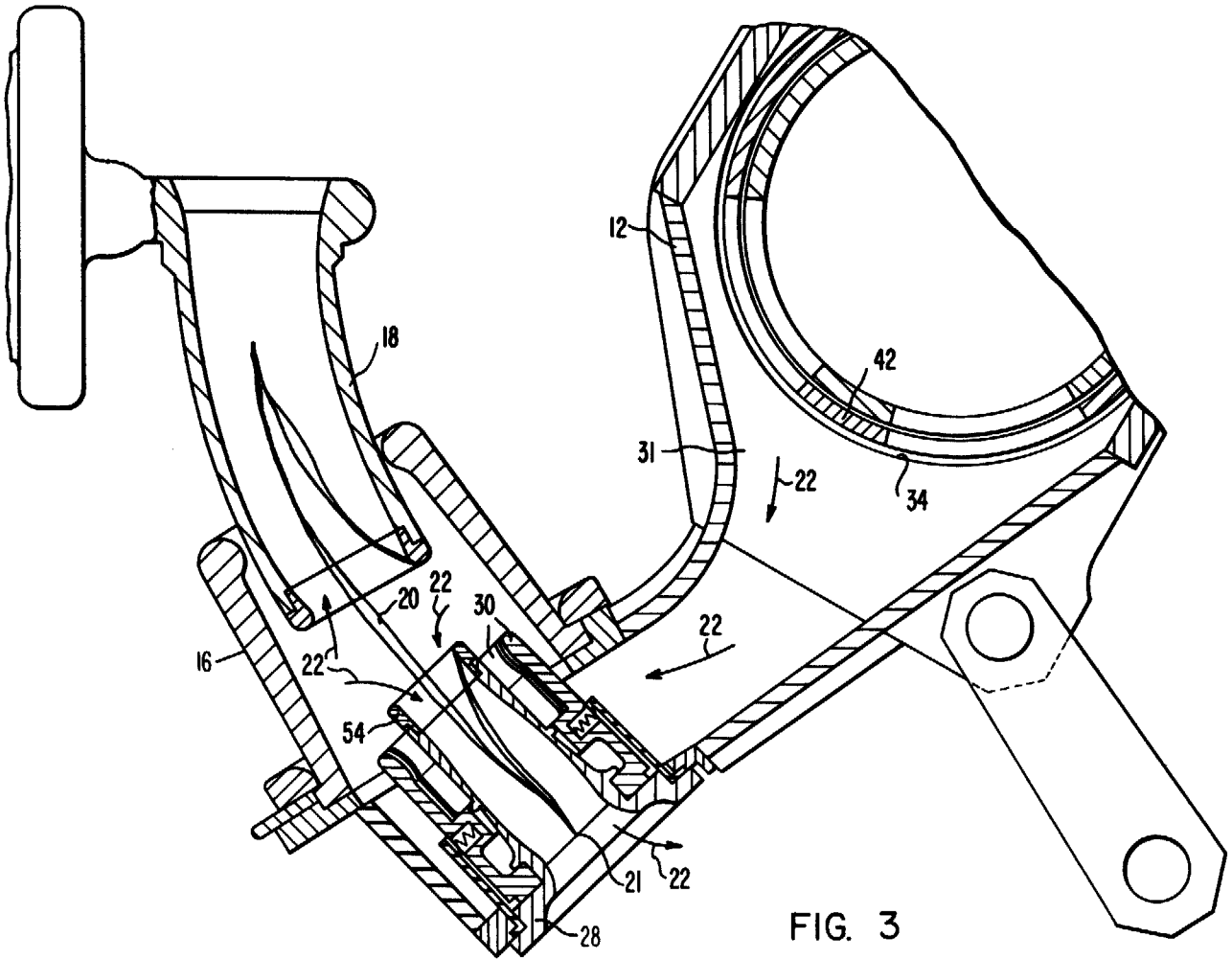
FIG. 3 is an enlarged fragmentary horizontal sectional view, showing the contacts in an open position and embodying the principles of the present invention.

During opening of the contacts, the contact fingers 30 are first separated from the outer sides of the tubular main stationary contact 18 to create the arc 20 (FIG. 3)

between the movable tubular arcing horn 28 and the stationary tubular contact 18. The rotatable cross-arm assembly 12 comprises a pair (one shown) of spaced side plates 31, having journal openings 34 (one shown), respectively, which in conjunction with bearings, rotatably support the cross-arm assembly 12 on an apertured bearing and blast valve support 36. The support 36 is secured by bolts 38 to an auxiliary reservoir tank 40. During the opening operation of the contacts, high pressure arc-extinguishing gas, such as sulfur hexafluoride ($SF_6$) gas, flows as indicated by the gas flow arrows 22 from the tank 40 to the cross-arm assembly 12 to the zone (FIG. 3) of the movable and stationary contacts 16, 18.

In accordance with this invention, it has been found that a more satisfactory extinction of the arc 20 may be obtained by providing a gas pressure of ten or more atmospheres producing gas flow as indicated by the arrows 22 to extend the arc 20 in opposite directions into the stationary tubular contact 18 and the movable tubular contact 16. Thus, the arc 20, near a current zero moment, includes a pair of loops 21, each extending in the opposite direction. In cases of a short line fault, the rate of circuit voltage recovery just after current zero is so high that the arc may not be extinguished at current zero. In such event arc extinction depends upon an energy balance process just after current zero and the arc interruption is facilitated by an increase in the arc voltage which is obtained by lengthening the arc near current zero. Thus it is more advantageous to work on a long arc column than on a shorter arc.

As shown in FIG. 2 the reservoir tank 40 is a cylinder-like member having a movable piston or flexible diaphragm 42 which divides the tank into two compartments 44 and 46. The compartment 44 communicates (FIG. 3) through a conduit between side plates 31, and as shown by arrows 22, with a zone surrounding the contacts 16, 18. The compartment 44 contains arc-extinguishing gas such as $SF_6$.

The compartment 46 is contained between the piston 42 and an end wall 48 of the tank 40 and communicates with a supply conduit 50 which leads to a source of compressed gas (not shown). A valve 52 is located in the conduit 50. The preferred gas for the compartment 46 is compressed air.

After the compartment 44 has been exhausted in response to opening of the contacts 16, 18, the compartment 44 is exhausted of $SF_6$ gas. A supply conduit 54 communicates with the compartment 44 and is connected at its other ends to a source of gas. For example, the end of the conduit 54 remote from the compartment 44 may be connected to a gas pump which removes $SF_6$ gas within the outer housing of the interrupter such as contained within an interrupter tank 56 and a support column 58. When the circuit interrupter is in the closed-circuit position the $SF_6$ gas is normally maintained within the compartment 44 at a maximum pressure of about 260 psi. A blast valve 60 closes the passage formed by the side plates 31 to prevent the gas from leaking from the compartment 44. A one-way check valve 62 is disposed in the conduit 54.

When the contacts 16, 18 are closed, the condition of the piston 42 is substantially as shown in FIG. 2; that is, the pressures of the gases within the compartments 44 and 46 are substantially equal. When an overload occurs to cause the contacts 16, 18 to open, the blast valve 60 opens to release $SF_6$ gas from the compartment 44. Simultaneously, the valve 52 opens to increase the air pressure on the piston 42 and therefore on the $SF_6$ gas in the compartment 44. Accordingly, the air pressure in the compartment 46 may exceed 800 psi in order to provide a pressure of about 600 psi on the extinguishing gas.

The movable piston 42 comprises a peripheral flange 64 or other means extending in either direction of the plane of the piston to facilitate sliding of the piston periphery along the inner surface of the cylinder and prevent gas leaking from one side of the piston to the other. In operation, when the contacts 16, 18 are closed, the valve 60 is closed and $SF_6$ gas is returned to the compartment 44 through the conduit 54 to return the piston 42 to the position shown in FIG. 2 where it remains until the circuit interrupter is subsequently operated to open a circuit through the contacts.

Accordingly, the device of this invention provides an increase in instantaneous pressure through rapid adiabatic compression of gas in the reservoir volume by mechanical, hydraulic or pneumatic means. For that purpose a two-pressure type circuit breaker is involved in which the gas pressure in the high pressure reservoir is increased appreciably during the instant of circuit breaker operation so that a higher interruption rate is obtained.

What is claimed is:

1. A high compression two-pressure type circuit interrupter comprising a housing, a stationary contact within the housing, a movable contact within the housing and separable from the stationary contact to establish an arc, mounting means for mounting and moving the movable contact, means for directing a blast of an interrupting gas into the zone between the separating contacts to extinguish an arc and comprising a puffer cylinder and conduit means extending between the cylinder and said zone, the puffer cylinder being separated into two unconnected compartments by a pressure responsive divider, one compartment having an outlet port communicating with the conduit means and containing an arc extinguishing gas, the other compartment communicating with a source of pressurized fluid, and valve means for releasing the fluid into said other compartment in response to a current overload to push the gas from the one compartment to the zone.

2. The circuit interrupter of claim 1 in which the mounting means comprises a tubular portion and the conduit means communicates with the tubular portion.

3. The circuit interrupter of claim 2 in which said divider is a piston movably mounted within the cylinder in response to increased pressure of the gas in either compartment.

4. The circuit interrupter of claim 2 in which said one compartment having inlet port means comprising one-way valve means for closing the inlet port means to prevent reverse flow of said gas when the contacts are separated.

5. The circuit interrupter of claim 1 in which the pressurized fluid is compressed air.

* * * * *